US009814366B2

(12) United States Patent
Galban

(10) Patent No.: US 9,814,366 B2
(45) Date of Patent: Nov. 14, 2017

(54) DISHWASHER APPLIANCE AND A METHOD FOR OPERATING A DISHWASHER APPLIANCE

(71) Applicant: General Electric Company, Schenectady, NY (US)

(72) Inventor: Lazaro Galban, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 164 days.

(21) Appl. No.: 14/596,279

(22) Filed: Jan. 14, 2015

(65) Prior Publication Data

US 2016/0198930 A1 Jul. 14, 2016

(51) Int. Cl.

| | |
|---|---|
| ***B08B 9/20*** | (2006.01) |
| ***A47L 15/42*** | (2006.01) |
| ***A47L 15/22*** | (2006.01) |
| ***A47L 15/50*** | (2006.01) |

(52) U.S. Cl.

CPC ..... *A47L 15/4221* (2013.01); *A47L 15/22* (2013.01); *A47L 15/508* (2013.01)

(58) Field of Classification Search

CPC ..... A47L 15/4221; A47L 15/4217; A47L 15/4278

USPC ..... 134/25.2

See application file for complete search history.

(56) References Cited

FOREIGN PATENT DOCUMENTS

| | | |
|---|---|---|
| EP | 0780086 A2 | 6/1997 |
| EP | 0930044 A1 | 7/1999 |

*Primary Examiner* — Eric Golightly

(74) *Attorney, Agent, or Firm* — Dority & Manning, P.A.

(57) ABSTRACT

A dishwasher appliance includes a first spray assembly and a second spray assembly disposed within a wash chamber of a tub. A hydraulic switch of the dishwasher appliance has a first outlet conduit that extends towards the first spray assembly and a second outlet conduit that extends towards the second spray assembly. A plug of the hydraulic switch is movable between the first outlet conduit and the second outlet conduit. The hydraulic switch may permit a flow of wash fluid to either the first spray assembly or the second spray assembly. A related method for operating a dishwasher appliance is also provided.

12 Claims, 6 Drawing Sheets

DISHWASHER APPLIANCE AND A METHOD FOR OPERATING A DISHWASHER APPLIANCE

FIELD OF THE INVENTION

The present subject matter relates generally to dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, wash fluid is directed to separate spray assemblies at a fixed ratio. Thus, a first one of the spray assemblies may receive about seventy percent of a flow of wash fluid from a supply conduit while a second one of the spray assemblies may receive about thirty percent of the flow of wash fluid from the supply conduit. The fixed ratio of wash fluid flow can provide a convenient distribution of wash fluid when both the first and second spray assemblies are needed but can be inefficient when either the first spray assembly or the second spray assembly is not needed.

Accordingly, a dishwasher appliance with features for regulating fluid flow to various spray assemblies of the dishwasher appliance would be useful. In particular, a dishwasher appliance with features for selectively directing wash fluid to a secondary spray assembly of the dishwasher appliance would be useful.

BRIEF DESCRIPTION OF THE INVENTION

The present subject matter provides a dishwasher appliance. The dishwasher appliance includes a first spray assembly and a second spray assembly disposed within a wash chamber of a tub. A hydraulic switch of the dishwasher appliance has a first outlet conduit that extends towards the first spray assembly and a second outlet conduit that extends towards the second spray assembly. A plug of the hydraulic switch is movable between the first outlet conduit and the second outlet conduit. The hydraulic switch may permit a flow of wash fluid to either the first spray assembly or the second spray assembly. A related method for operating a dishwasher appliance is also provided. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber. A first spray assembly is disposed within the wash chamber of the tub, and a second spray assembly is also disposed within the wash chamber of the tub. A circulation conduit is coupled to the first and second spray assemblies. The circulation conduit is configured for directing a flow of wash fluid to either the first spray assembly or the second spray assembly. The circulation conduit has a hydraulic switch. The hydraulic switch includes an inlet conduit. A first outlet conduit is mounted to the inlet conduit and extends towards the first spray assembly. A second outlet conduit is mounted to the inlet conduit and extends towards the second spray assembly. A plug is disposed within the hydraulic switch such that the plug is movable between the first outlet conduit and the second outlet conduit.

In a second exemplary embodiment, a method for operating a dishwasher appliance is provided. The dishwasher appliance has a circulation conduit coupled to a first assembly and a second spray assembly. The circulation conduit has a hydraulic switch with a plug. The method includes operating a pump of the dishwasher appliance. A first outlet conduit of the circulation conduit directs a flow of wash fluid from the pump to the first spray assembly of the dishwasher appliance during the step of operating. The plug of the circulation conduit is positioned within a second outlet conduit of the circulation conduit during the step of operating. The method also includes deactivating the pump of the dishwasher appliance after the step of operating such that the plug of the circulation conduit moves from the second outlet conduit of the circulation conduit to the first outlet conduit of the circulation conduit. The method further includes working the pump of the dishwasher appliance after the step of deactivating. The second outlet conduit of the circulation conduit directs the flow of wash fluid from the pump to the second spray assembly of the dishwasher appliance during the step of working. The plug of the circulation conduit is positioned within the first outlet conduit of the circulation conduit during the step of working.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
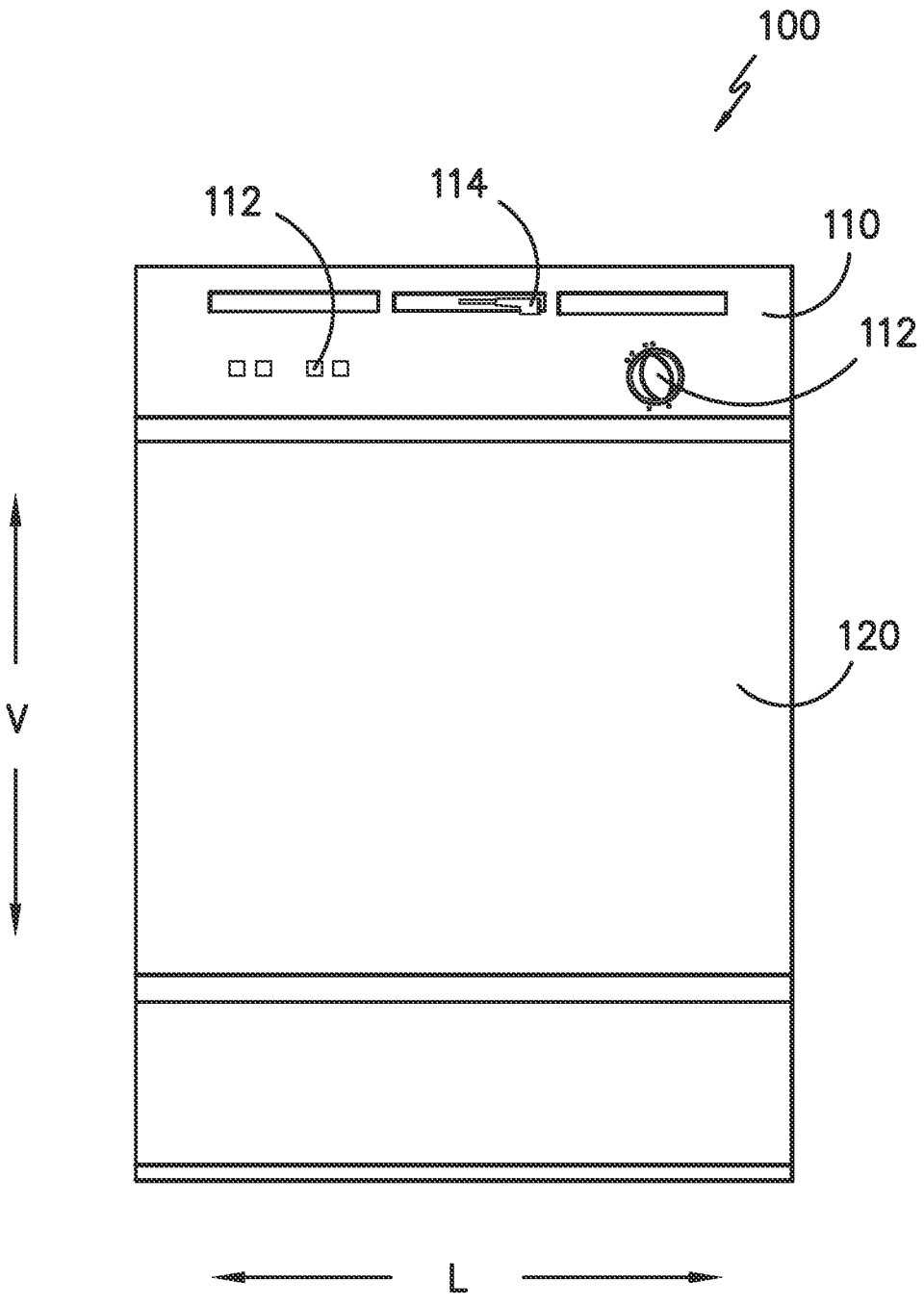
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
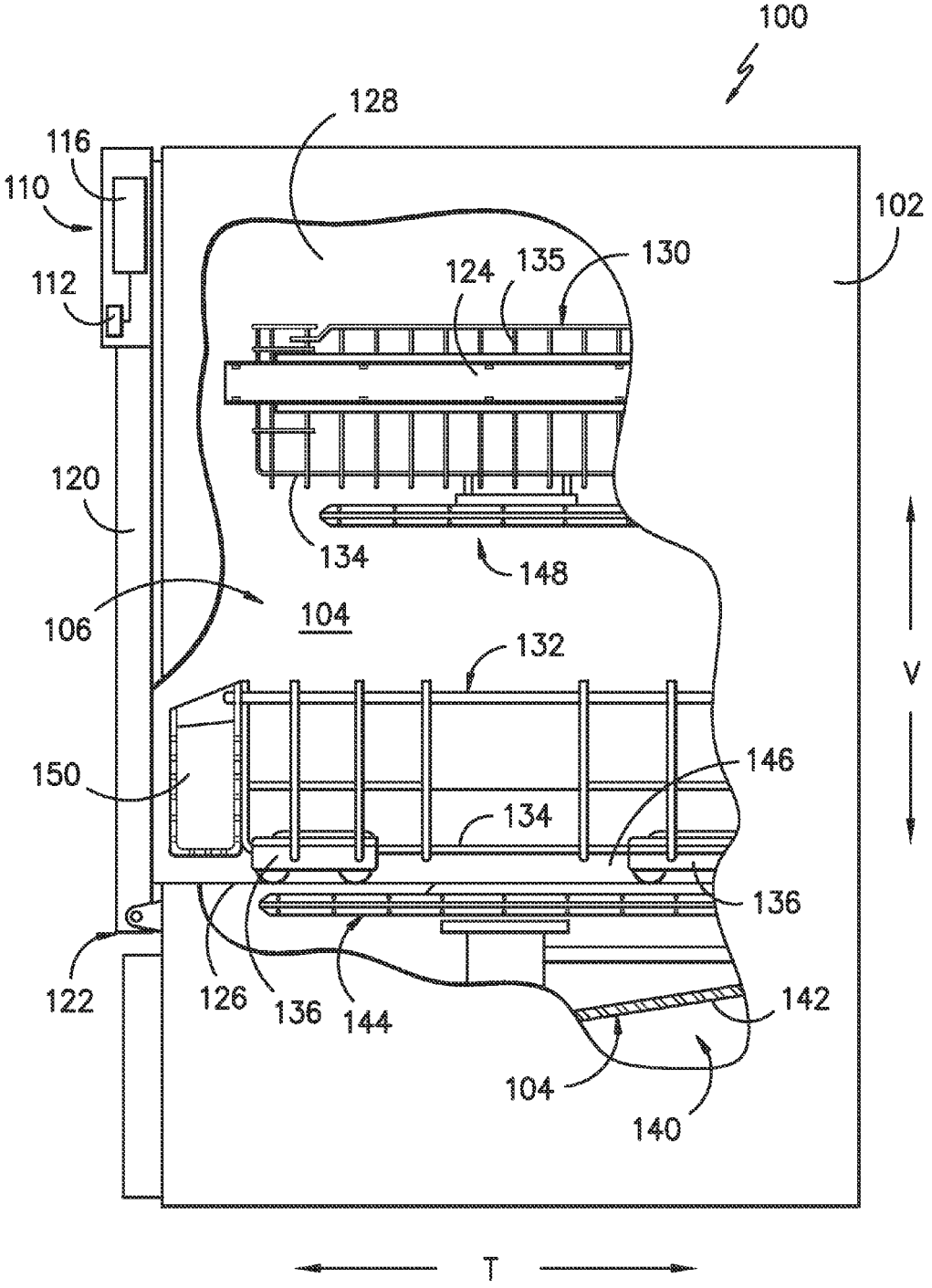
FIG. 2 provides a partial side section view of the exemplary dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 and/or lower and mid-level spray assemblies 144, 148, and other differences may be applied as well.

Figure 3:
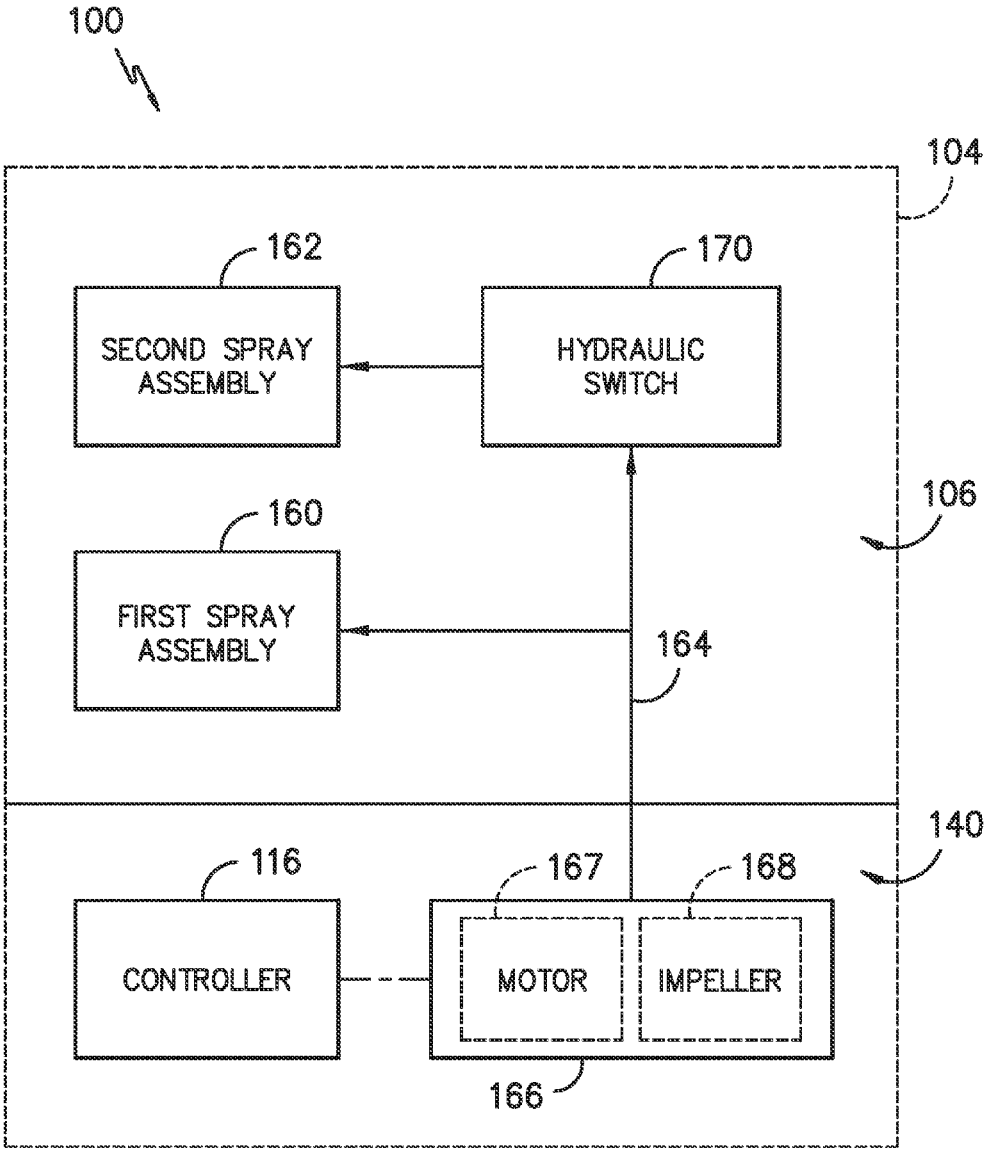
FIG. 3 provides a schematic view of certain components of the exemplary dishwasher appliance of FIG. 1.
Figure 4:
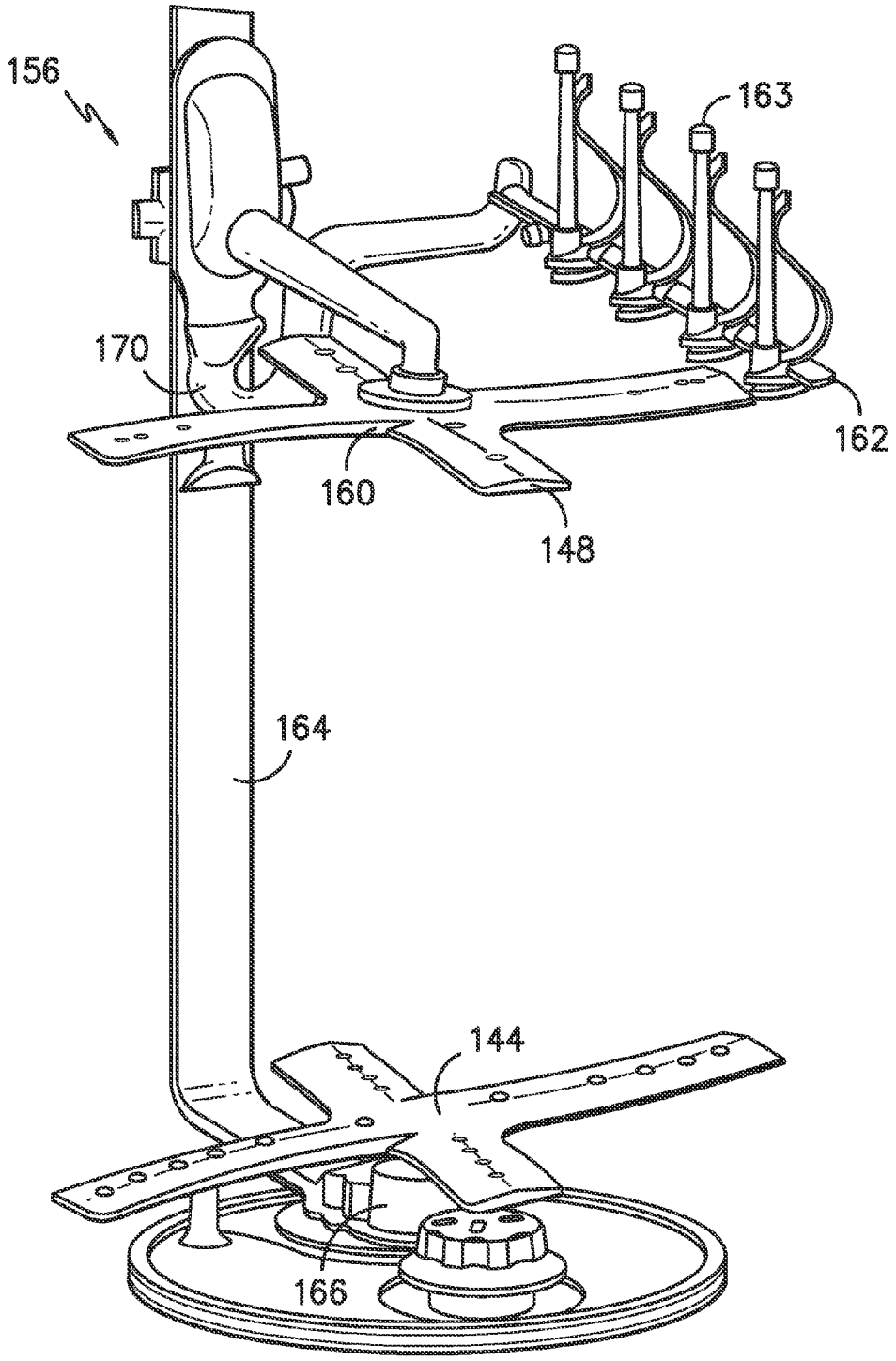
FIG. 4 provides a perspective view of a fluid circulation assembly of the exemplary dishwasher appliance of FIG. 1.

FIG. 3 provides a schematic view of certain components of dishwasher appliance 100. FIG. 4 provides a perspective view of a fluid circulation assembly 156 of dishwasher appliance 100. As may be seen in FIGS. 3 and 4, dishwasher appliance 100 includes a first spray assembly 160 and a second spray assembly 162. First and second spray assemblies 160, 162 are positioned and oriented for directing respective flows of wash fluid towards articles within wash chamber 106 of tub 104. The flows of wash fluid from first and second spray assemblies 160, 162 assist with cleaning articles within upper and/or lower rack assemblies 130, 132 (FIG. 2), as will be understood by those skilled in the art. Thus, dishwasher appliance 100 includes features for, e.g., selectively, directing multiple flows of washing fluid into wash chamber 106 of tub 104.

First spray assembly 160 may be positioned and/or be oriented for directing a first flow of wash fluid towards or into upper rack assembly 130. For example, first spray assembly 160 may be a spray arm, such as mid-level spray assembly 148 of dishwasher appliance 100 as shown in FIG. 4. Thus, first spray assembly 160 may be a spray arm rotatably mounted to upper rack assembly 130 at a bottom portion of upper rack assembly 130. However, it should be understood that first spray assembly 160 may be any suitable spray assembly in alternative exemplary embodiments. For example, first spray assembly 160 may be lower spray assembly 144, a bottle washer, a bowl scrubber, etc., in alternative exemplary embodiments.

Second spray assembly 162 may be positioned and/or be oriented for directing a second flow of wash fluid towards or into upper rack assembly 130. For example, second spray assembly 162 may be a bottle washer 163, as shown in FIG. 4. Thus, second spray assembly 162 may be positioned above first spray assembly 160. However, it should be understood that second spray assembly 162 may be any suitable spray assembly in alternative exemplary embodiments. For example, second spray assembly 162 may be the upper spray assembly, a bowl scrubber, etc., in alternative exemplary embodiments.

Dishwasher appliance 100 also includes a supply or circulation conduit 164 and a pump 166. Pump 166 may be positioned within machinery compartment 140 adjacent or below tub sump portion 142. Circulation conduit 164 extends from pump 166 to first and second spray assemblies 160, 162. Circulation conduit 164 places first and second spray assemblies 160, 162 in fluid communication with pump 166. Thus, circulation conduit 164 is configured for directing wash fluid from pump 166 to first or second spray assemblies 160, 162 during operation of pump 166. At least a portion of circulation conduit 164 may be mounted to a back wall of tub 104.

Figure 8:
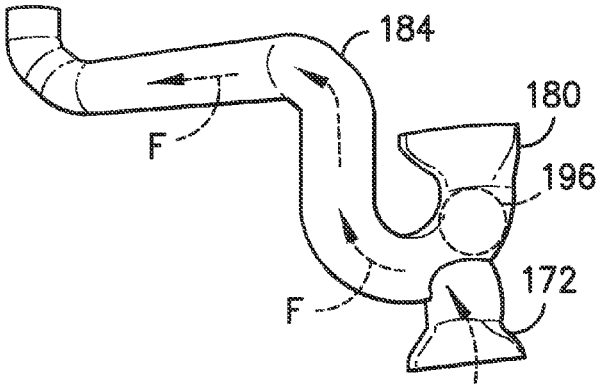

A hydraulic switch 170 is coupled, e.g., mounted, to circulation conduit 164 such that hydraulic switch 170 selectively permits wash fluid from circulation conduit 164 to flow to first spray assembly 160 or second spray assembly 162. For example, hydraulic switch 170 may selectively adjusted between a first configuration (FIG. 6) and a second configuration (FIG. 8). In particular, hydraulic switch 170 may adjust from the first configuration to the second configuration via operation of pump 166, as discussed in greater detail below. Hydraulic switch 170 may be positioned at any suitable location within dishwasher appliance 100. For example, hydraulic switch 170 may be positioned on the back wall of tub 104 at or adjacent upper rack assembly 130.

Pump 166 includes a motor 167 and an impeller 168. Impeller 168 is coupled to motor 167, e.g., a shaft of motor 167. Thus, during operation of motor 167, impeller 168 may rotate and draw wash fluid from tub sump portion 142 to pump 166. From pump 166, wash fluid flows through circulation conduit 164 to hydraulic switch 170 and first spray assembly 160 or second spray assembly 162, as discussed in greater detail below. Controller 116 is in operative communication with pump 166, e.g., motor 167 of pump 166. For example, controller 116 may be configured for operating motor 167 such that motor 167 rotates impeller 168.

FIGS. 5, 6, 7 and 8 provide perspective views of hydraulic switch 170 of fluid circulation assembly 156 with a plug 196 of hydraulic switch 170 shown in various positions. As may be seen in FIG. 5, hydraulic switch 170 includes an inlet conduit 172, a first outlet conduit 180, a second outlet conduit 184 and a plug 196. First outlet conduit 180 is mounted to inlet conduit 172 and extends towards first spray assembly 160. Thus, first outlet conduit 180 may be fluidly coupled to first spray assembly 160 in order to direct wash fluid from inlet conduit 172 to first spray assembly 160. Second outlet conduit 184 is mounted to inlet conduit 172 and extends towards second spray assembly 162. Thus, second outlet conduit 184 may be fluidly coupled to second spray assembly 162 in order to direct wash fluid from inlet conduit 172 to second spray assembly 162.

Plug 196 is disposed within hydraulic switch 170 such that plug 196 is movable between first outlet conduit 180 and second outlet conduit 184. Movement of plug 196 within hydraulic switch 170 assists with adjusting hydraulic switch 170 between a first configuration (FIG. 6) and a second configuration (FIG. 8), as discussed in greater detail below. Plug 196 may have any suitable shape. For example, plug 196 may be spherically shaped to assist movement of plug 196 within hydraulic switch 170. Plug 196 may also be buoyant such that plug 196 floats on fluid within hydraulic switch 170. Thus, plug 196 may be a hollow, plastic sphere in certain exemplary embodiments.

Figure 6:
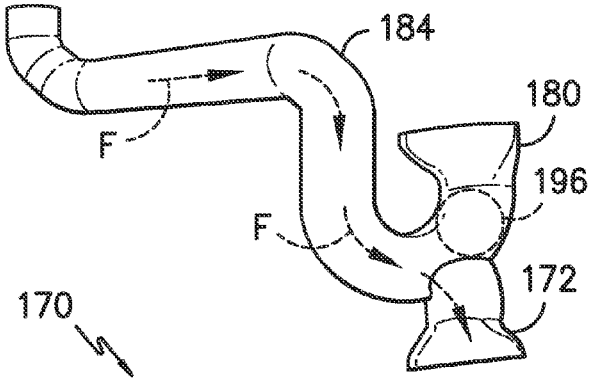

As shown in FIG. 6, hydraulic switch 170 blocks or hinders wash fluid in circulation conduit 164 from flowing to second spray assembly 162 when hydraulic switch 170 is in the first configuration. Thus, second spray assembly 162 is inactive or idle when hydraulic switch 170 is in the first configuration. Conversely, hydraulic switch 170 permits wash fluid in circulation conduit 164 to flow to first spray assembly 160 when hydraulic switch 170 is in the first configuration. Thus, first spray assembly 160 is active or operational when hydraulic switch 170 is in the first configuration.

As shown in FIG. 8, hydraulic switch 170 permits wash fluid in circulation conduit 164 to flow to second spray assembly 162 when hydraulic switch 170 is in the second configuration. Thus, second spray assembly 162 is active or operational when hydraulic switch 170 is in the second configuration. Conversely, hydraulic switch 170 blocks or prevents wash fluid in circulation conduit 164 from flowing to first spray assembly 160 when hydraulic switch 170 is in the second configuration. Thus, first spray assembly 160 is inactive or idle when hydraulic switch 170 is in the second configuration.

Figure 5:
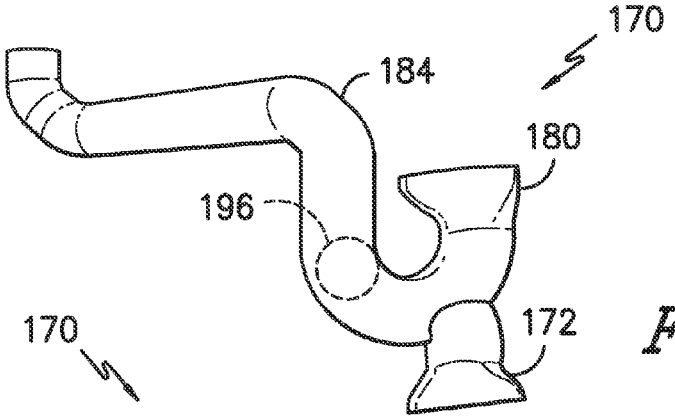
FIGS. 5, 6, 7 and 8 provide perspective views of a hydraulic switch of the fluid circulation assembly of FIG. 4 with a plug of the hydraulic switch shown in various positions.

Operation of pump 166 may assist with adjusting hydraulic switch 170 between the first and second configurations. Operation of pump 166 to adjust hydraulic switch 170 between the first and second configurations is discussed in greater detail below with reference to FIGS. 5, 6, 7 and 8. Turning to FIG. 5, pump 166 is deactivated or not operating and hydraulic switch 170 is generally drained of wash fluid. In such conditions, plug 196 is positioned within second outlet conduit 184, e.g., at a nadir 190 (FIG. 10) of a curved section 188 (FIG. 10) of second outlet conduit 184. The configuration of hydraulic switch 170 shown in FIG. 5 may generally correspond to a default configuration of hydraulic switch 170, e.g., when dishwasher appliance 100 is not operating or active.

When a user activates dishwasher appliance 100, pump 166 is used to circulate wash fluid within tub 104. Thus, turning to FIG. 6, pump 166 is operated or activated in order to urge wash fluid through hydraulic switch 170. As shown in FIG. 6, first outlet conduit 180 directs a flow of wash fluid F from pump 166 to first spray assembly 160. The flow of wash fluid F from pump 166 also urges plug 196 upwardly within second outlet conduit 184 until plug 196 obstructs the flow of wash fluid F within second outlet conduit 184 to second spray assembly 162. However, wash fluid from the flow of wash fluid F may seep around plug 196 while pump 166 is operating, as shown in FIG. 6. Thus, a head of wash fluid may build up within second outlet conduit 184 behind plug 196 while pump 166 is operating.

Figure 7:
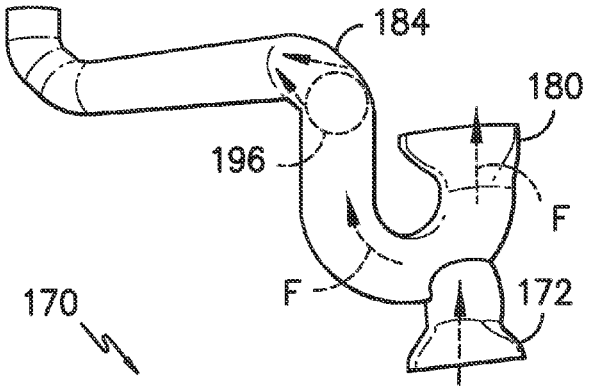

Turning now to FIG. 7, pump 166 may be deactivated or tuned off after operating pump 166 in the manner described above with reference to FIG. 6. Deactivating pump 166 may assist with adjusting hydraulic switch 170 from the first configuration shown in FIG. 6 to the second configuration shown in FIG. 8. Thus, plug 196 moves from second outlet conduit 184 to first outlet conduit 180 when pump 166 is deactivated. In particular, the head of wash fluid behind plug 196 may force plug 196 to move from second outlet conduit 184 to first outlet conduit 180 when pump 166 is deceived. Thus, wash fluid within second outlet conduit 184 may urge plug 196 from second outlet conduit 184 to first outlet conduit 180 as wash fluid within second outlet conduit 184 drains from second outlet conduit 184 after pump is deactivated, as shown in FIG. 7.

After plug 196 moves to first outlet conduit 180, pump 166 may be reactivated and worked. As shown in FIG. 8, with hydraulic switch 170 in the second configuration, second outlet conduit 184 directs the flow of wash fluid F from pump 166 to second spray assembly 162, and plug 196 may block or obstruct the flow of wash fluid F to first spray assembly 160 from first outlet conduit 180. To prevent plug 196 from returning to the default configuration shown in FIG. 5, pump may be reactivated or worked shortly after deactivating pump 166 in the manner described above with reference to FIG. 7. For example, pump 166 may be reactivated within one second, within three second, within five seconds, within ten seconds, etc. of deactivating pump 166.

As discussed above, hydraulic switch 170 selectively permits wash fluid from circulation conduit 164 to flow to first spray assembly 160 or second spray assembly 162. Thus, controller 116 may selectively operate first and second spray assemblies 160, 162 by operating motor 167 in the manner described above. Hydraulic switch 170 can assist with increasing an efficiency of dishwasher appliance 100 and/or improving a consumer satisfaction with dishwasher appliance 100. For example, hydraulic switch 170 permits a user of dishwasher appliance 100 to deactivate second spray assembly 162 when second spray assembly 162 is not needed. By only directing wash fluid to second spray assembly 162 when needed, a supply of wash fluid to first spray assembly 160 can be increased when second spray assembly 162 is not required or in use.

Figure 9:
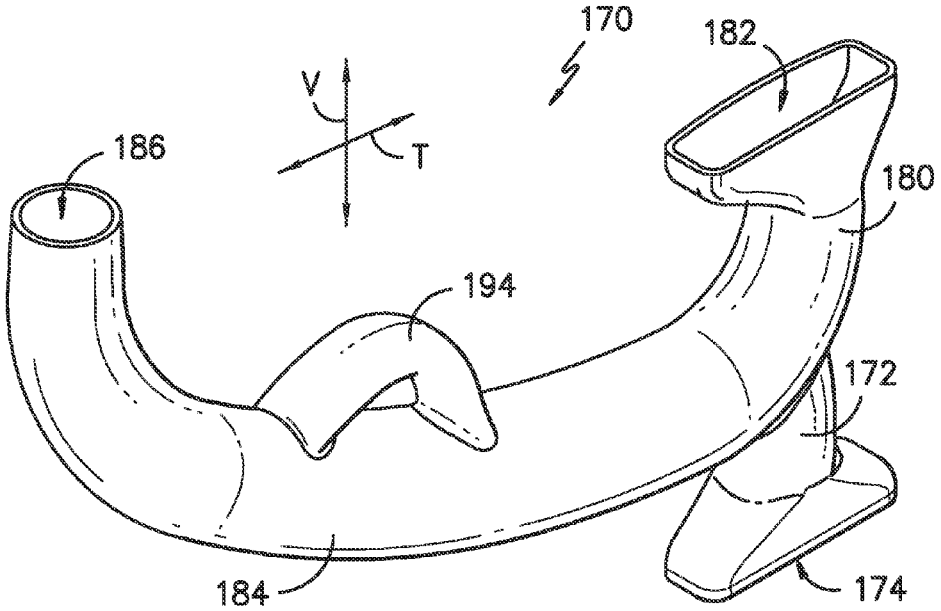
FIG. 9 provides a perspective view of a hydraulic switch according to another exemplary embodiment of the present subject matter.
Figure 10:
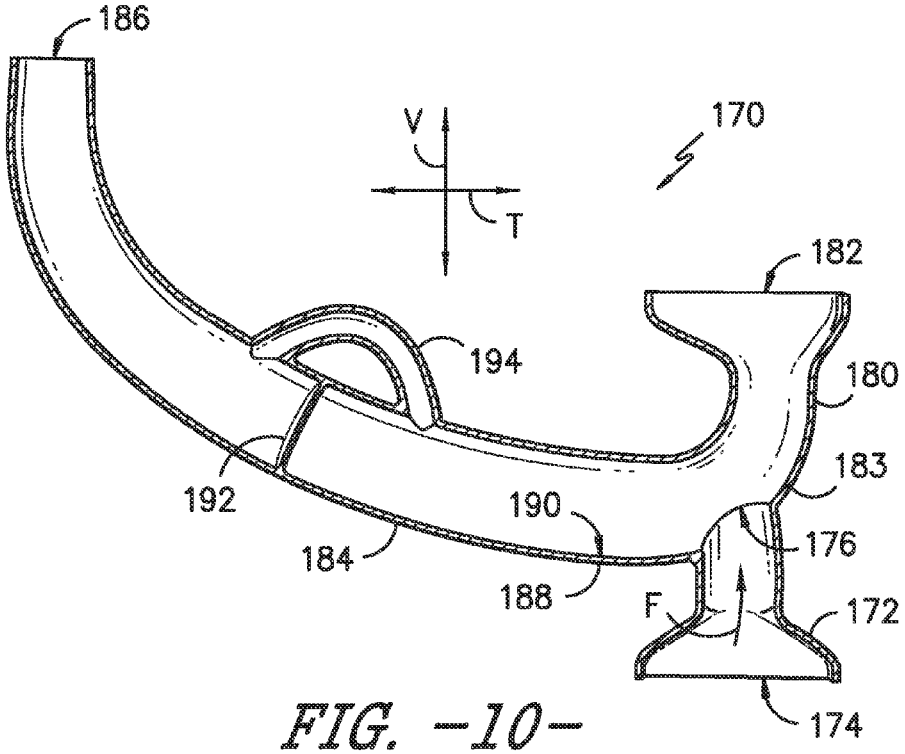
FIG. 10 provides a section view of the exemplary hydraulic switch of FIG. 9.

FIG. 9 provides a perspective view of hydraulic switch 170 according to another exemplary embodiment of the present subject matter. FIG. 10 provides a section view of hydraulic switch 170 of FIG. 9. As may be seen in FIGS. 9 and 10, hydraulic switch 170 defines a vertical direction V and a transverse direction T. The transverse direction T is perpendicular to the vertical direction V.

As may be seen in FIG. 10, inlet conduit 172 includes an entrance 174 and an exit 176. Entrance 174 of inlet conduit 172 is configured and may be positioned for receiving the flow of wash fluid F from pump 166 via circulation conduit 164. Thus, hydraulic switch 170 may be coupled to circulation conduit 164 at entrance 174 of inlet conduit 172. Exit 176 of inlet conduit 172 is disposed downstream of entrance 174 of inlet conduit 172 relative to the flow of wash fluid F from pump 166. The flow of wash fluid F may exit inlet conduit 172 at exit 176 of inlet conduit 172 and flow into either first outlet conduit 180 or second outlet conduit 184, as discussed above.

Second outlet conduit 184 also has a curved section or segment 188. A nadir 190 of curved segment 188 of second outlet conduit 184 is positioned below exit 176 of inlet conduit 172 along the vertical direction V. Thus, plug 196 may rest at nadir 190 of curved segment 188 of second outlet conduit 184 when hydraulic switch 170 is in the default configuration (FIG. 5). Nadir 190 of curved segment 188 of second outlet conduit 184 is also spaced apart from exit 176 of inlet conduit 172 along the transverse direction T. First outlet conduit 180 also has a curved section or segment 183. Curved segment 183 of first outlet conduit 180 may be positioned above nadir 190 of curved segment 188 of second outlet conduit 184, e.g., such that plug 196 rolls from the position shown in FIG. 8 to the position shown in FIG. 5 when hydraulic switch 170 is in the second configuration and pump 166 is deactivated.

As may be seen in FIG. 10, at least a portion of first outlet conduit 180 may be positioned directly above inlet conduit 172 along the vertical direction V. In particular, entrance 174 of inlet conduit 172 may be aligned with an exit 182 of first outlet conduit 180 along the vertical direction V. Entrance 174 of inlet conduit 172 may also be offset from an exit 186 of second outlet conduit 184 along the transverse direction T (and the vertical direction V).

Hydraulic switch 170 may also include a seat 192 disposed within second outlet conduit 184. Plug 196 may be positioned on or against seat 192 when hydraulic switch 170 is in the first configuration. A shape of seat 192 may be complementary to a shape of plug 196, e.g., such that plug 196 and seat 192 block or obstruct the flow of fluid F through second outlet conduit 184 when plug 196 is positioned on or against seat 192. Hydraulic switch 170 may further include a bypass conduit 194 mounted to second outlet conduit 184. Bypass conduit 194 extends around seat 192 on second outlet conduit 184. Bypass conduit 194 is configured for permitting wash fluid within second outlet conduit 184 to seep around plug 196 when hydraulic switch 170 is in the first configuration, as discussed above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a first spray assembly disposed within the wash chamber of the tub;

a second spray assembly disposed within the wash chamber of the tub; and a circulation conduit coupled to the first and second spray assemblies, the circulation conduit configured for directing a flow of wash fluid to either the first spray assembly or the second spray assembly, the circulation conduit having a hydraulic switch, the hydraulic switch comprising an inlet conduit;

a first outlet conduit mounted to the inlet conduit and extending towards the first spray assembly;

a second outlet conduit mounted to the inlet conduit and extending towards the second spray assembly;

a plug disposed within the hydraulic switch such that the plug is movable between the first outlet conduit and the second outlet conduit;

a seat disposed within the second outlet conduit, the plug positioned against the seat when the circulation conduit directs the flow of wash fluid to the first spray assembly; and a bypass conduit mounted to the second outlet conduit such that the bypass conduit extends around the seat on the second outlet conduit, the bypass conduit configured for permitting wash fluid within the second outlet conduit to seep around the plug when the circulation conduit directs the flow of wash fluid to the first spray assembly.

2. The dishwasher appliance of claim 1, wherein the circulation conduit defines a vertical direction and a transverse direction, the transverse direction being perpendicular to the vertical direction, at least a portion of the first outlet conduit positioned directly above the inlet conduit along the vertical direction.

3. The dishwasher appliance of claim 2, wherein an entrance of the inlet conduit is aligned with an exit of the first outlet conduit along the vertical direction.

4. The dishwasher appliance of claim 2, wherein an entrance of the inlet conduit is offset from an exit of the second outlet conduit along the transverse direction.

5. The dishwasher appliance of claim 1, wherein the circulation conduit defines a vertical direction and a transverse direction, the transverse direction being perpendicular to the vertical direction, the second outlet conduit having a curved segment, a nadir of the curved segment of the second outlet conduit positioned below an exit of the inlet conduit along the vertical direction.

6. The dishwasher appliance of claim 5, wherein the nadir of the curved segment is spaced apart from the exit of the inlet conduit along the transverse direction.

7. The dishwasher appliance of claim 5, wherein the first outlet conduit also has a curved segment, the curved segment of the first outlet conduit positioned above the nadir of the curved segment of the second outlet conduit.

8. The dishwasher appliance of claim 1, wherein the plug is spherically shaped.

9. The dishwasher appliance of claim 1, further comprising a rack disposed within the wash chamber of the tub, the first and second spray assemblies mounted to the rack.

10. The dishwasher appliance of claim 9, wherein the first spray assembly is a rotatable spray arm mounted at a bottom of the rack and the second spray assembly is a bottle blaster positioned above the first spray assembly within the rack.

11. The dishwasher appliance of claim 1, further comprising a pump coupled to the circulation conduit, the pump operable to urge the flow of wash fluid through the circulation conduit.

12. A dishwasher appliance, comprising:

a tub defining a wash chamber;

a rack disposed within the wash chamber of the tub;

a rotatable spray arm mounted at a bottom of the rack;

a bottle blaster positioned above the rotatable spray arm within the rack;

a circulation conduit coupled to the rotatable spray arm and the bottle blaster, the circulation conduit configured for directing a flow of wash fluid to either the rotatable spray arm or the bottle blaster, the circulation conduit having a hydraulic switch, the hydraulic switch comprising an inlet conduit;

a first outlet conduit mounted to the inlet conduit and extending towards the rotatable spray arm;

a second outlet conduit mounted to the inlet conduit and extending towards the the bottle blaster; and a plug disposed within the hydraulic switch such that the plug is movable between the first outlet conduit and the second outlet conduit.

* * * * *